US006050484A

United States Patent [19]

Galomb

[11] Patent Number: 6,050,484

[45] Date of Patent: Apr. 18, 2000

[54] CONVERTIBLE-RECLOSABLE BOX/CARTON WITH POUR SPOUT

[75] Inventor: David E. Galomb, Allentown, Pa.

[73] Assignee: Fres-co System USA, Inc., Telford, Pa.

[21] Appl. No.: 09/358,011

[22] Filed: Jul. 21, 1999

[51] Int. Cl.[7] ..... B65D 5/56

[52] U.S. Cl. ..... 229/222; 229/213; 229/217

[58] Field of Search ..... 229/213, 214, 229/217, 221, 222

[56] References Cited

U.S. PATENT DOCUMENTS

| | | | |
|---|---|---|---|
| 2,345,486 | 3/1944 | Leebov | 229/222 |
| 2,933,230 | 4/1960 | Yezek . | |
| 3,640,446 | 2/1972 | Grieve . | |
| 3,956,865 | 5/1976 | Schermund . | |
| 3,995,806 | 12/1976 | McSherry . | |
| 4,099,665 | 7/1978 | Bergstein | 229/213 |
| 4,101,051 | 7/1978 | Reil . | |
| 4,421,236 | 12/1983 | Lowe . | |
| 4,464,156 | 8/1984 | Holmström . | |
| 4,484,683 | 11/1984 | Werner, Jr. | 229/222 |
| 4,770,325 | 9/1988 | Gordon et al. . | |
| 4,921,104 | 5/1990 | Holmes . | |
| 4,930,683 | 6/1990 | Fäber . | |
| 4,989,780 | 2/1991 | Foote et al. . | |
| 5,007,542 | 4/1991 | Roccaforte . | |
| 5,067,613 | 11/1991 | Bryan . | |
| 5,067,615 | 11/1991 | Davitian . | |
| 5,326,024 | 7/1994 | Fogle | 229/214 |
| 5,333,781 | 8/1994 | Roccaforte . | |
| 5,344,066 | 9/1994 | Fogle . | |
| 5,680,986 | 10/1997 | Botterman . | |
| 5,685,479 | 11/1997 | Weber-Caspers . | |
| 5,816,486 | 10/1998 | Wein . | |

*Primary Examiner*—Gary E. Elkins
*Attorney, Agent, or Firm*—Caesar, Rivise, Bernstein, Cohen & Pokotilow, Ltd.

[57] ABSTRACT

A package, e.g., carton or box, for a flowable product, e.g., dry cereal. The carton/box has a planar front panel, a planar rear panel, a planar top panel, a planar bottom panel, a pair of planar side panels, and a closure assembly. The upper panel merges with the front panel at a front corner and merges with the rear panel at a rear corner. The upper panel includes two sections, pivotably connected to each other, with one of the sections located contiguous with the front corner and the other contiguous with the rear corner. The upper panel also has a first, e.g., U-shaped, portion arranged to be removed, e.g., torn away, adjacent one of the side panels to form a pouring spout. The closure assembly comprises a first releasably securable connector located adjacent the front corner, and a second releasably securable connector located adjacent the rear corner. The side panels of the package include plural preformed, e.g., weakened, lines located contiguous with the top panel. At least one of the lines in each side panel is severable parallel to the plane of the top panel immediately adjacent the top panel. The other lines in each side panel are foldable. The top panel also has a fold line extending fully thereacross between the two sections making up that panel. The package's spout is arranged to be re-closed by folding the two sections making up the top panel along it's fold line and bringing those portions of the front and rear panels contiguous with the front and rear corners into a confronting relationship with each other, whereupon they become releasably secured to hold the front and rear panels together and to close the spout.

32 Claims, 7 Drawing Sheets

FIG. 5
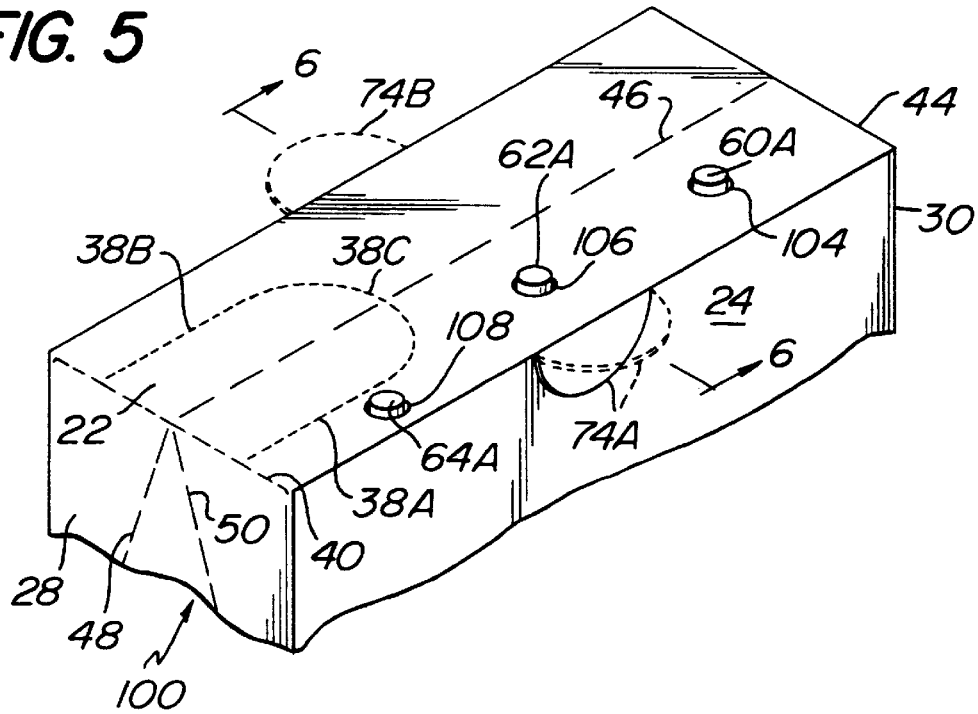
FIG. 6
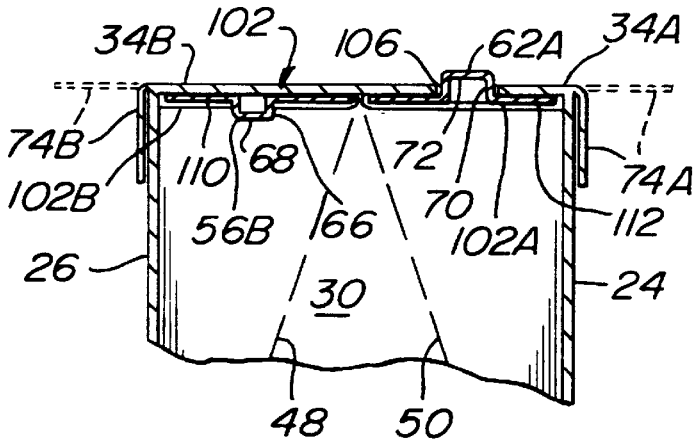
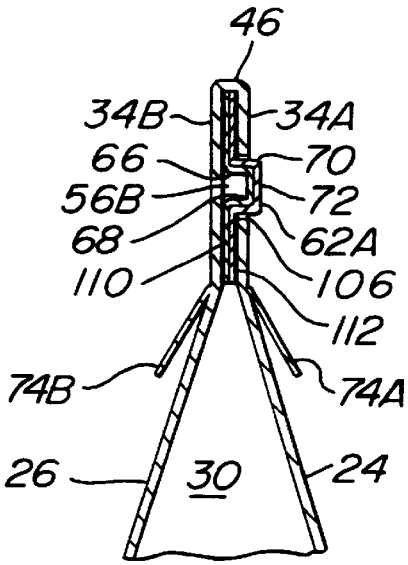
FIG. 7

FIG. 8
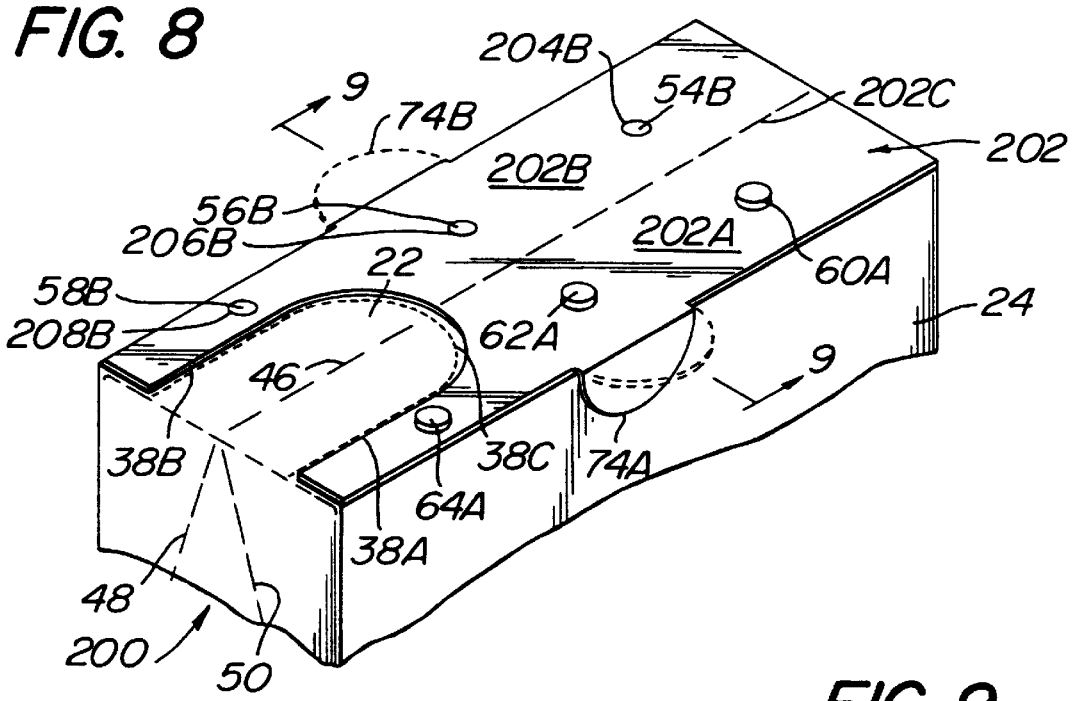
FIG. 9
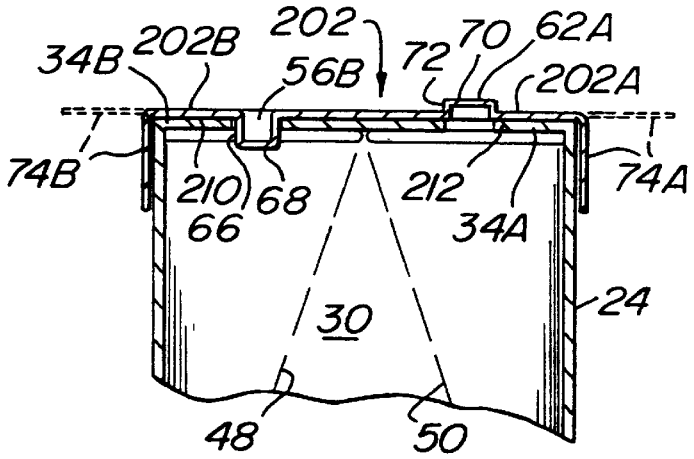
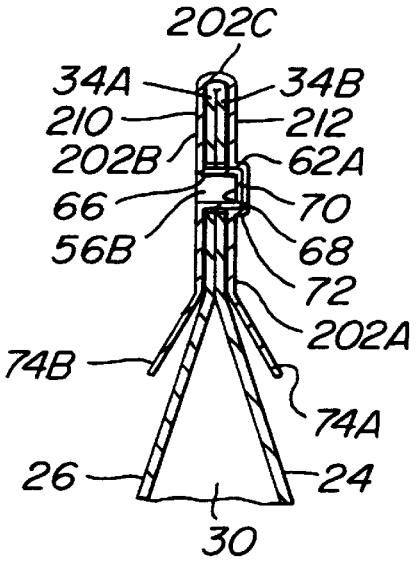
FIG. 10

FIG. 11
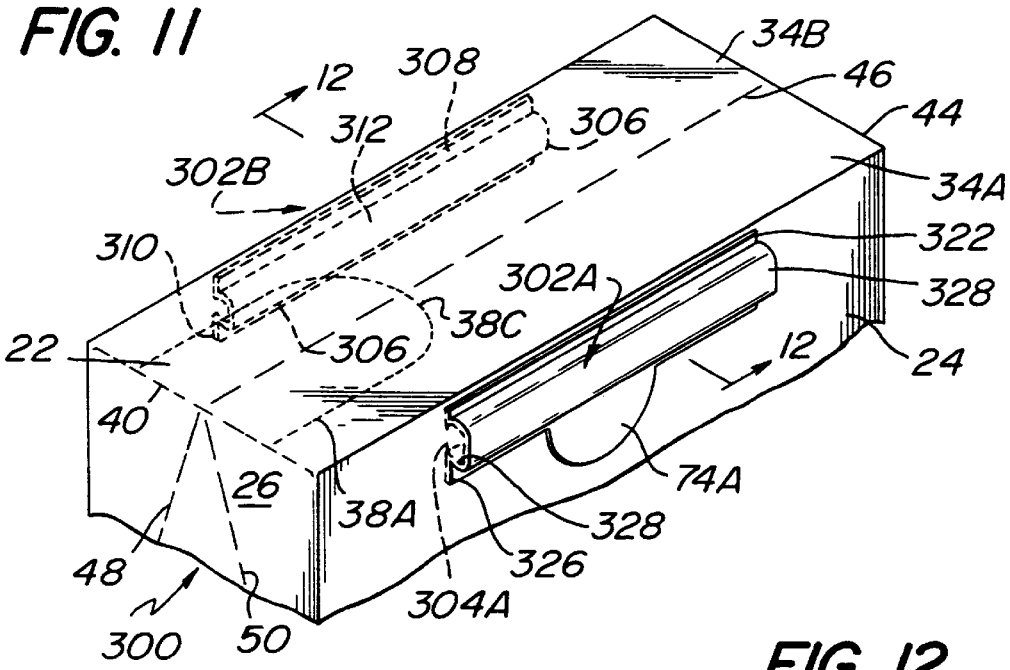
FIG. 12
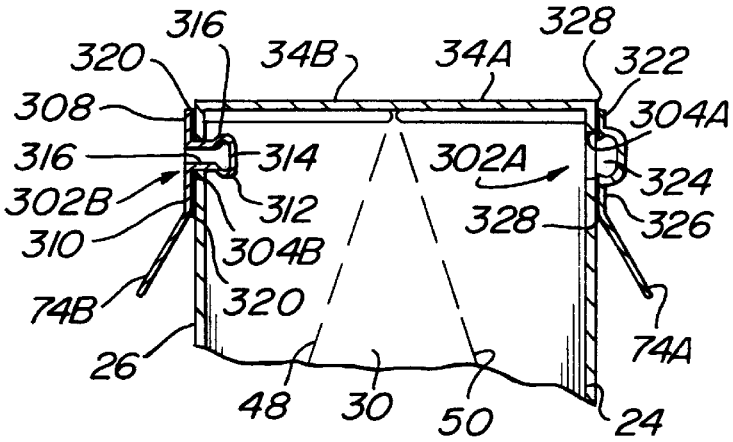
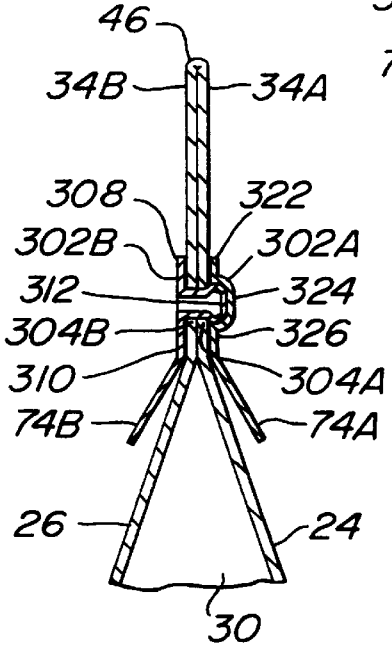
FIG. 13

FIG. 14
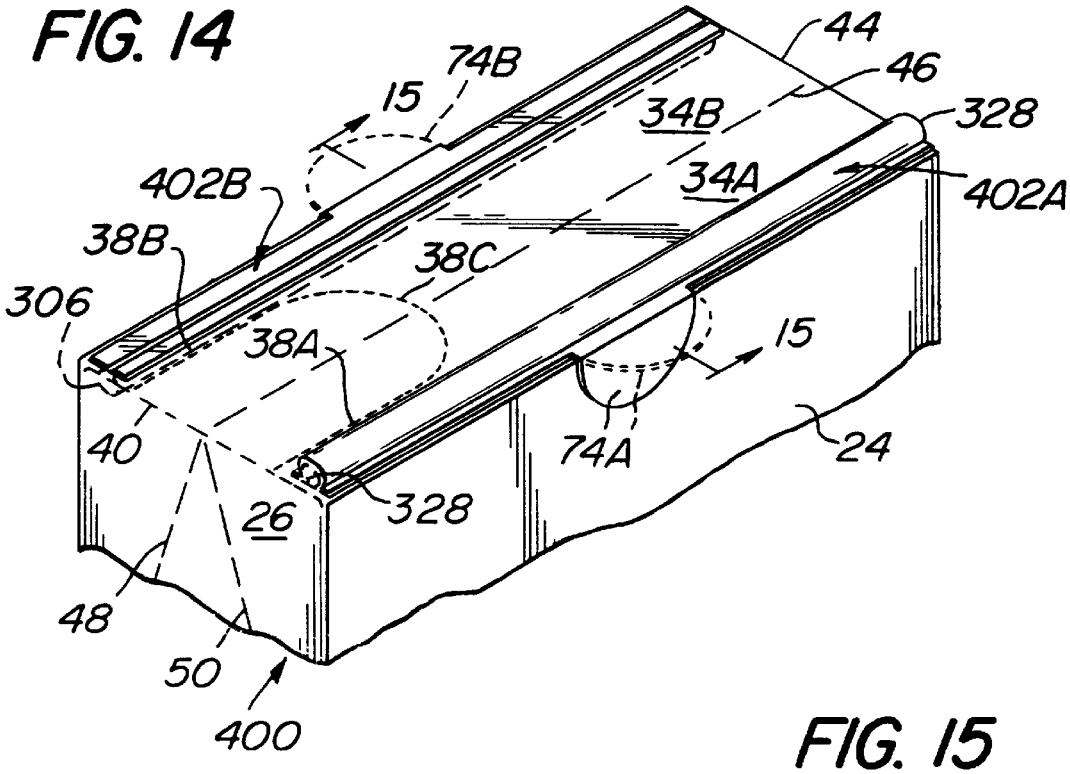
FIG. 15
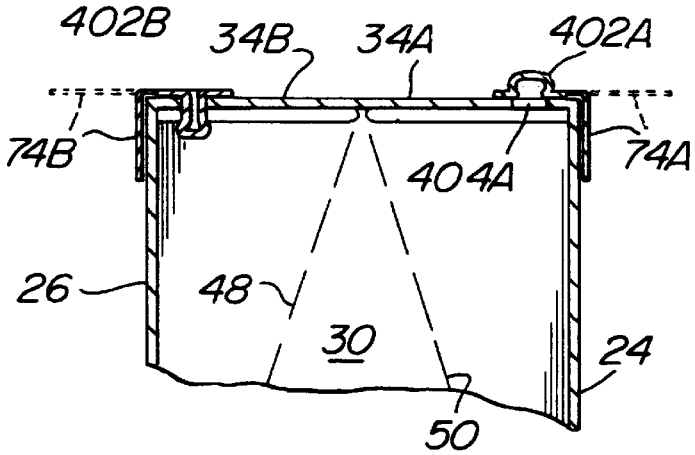
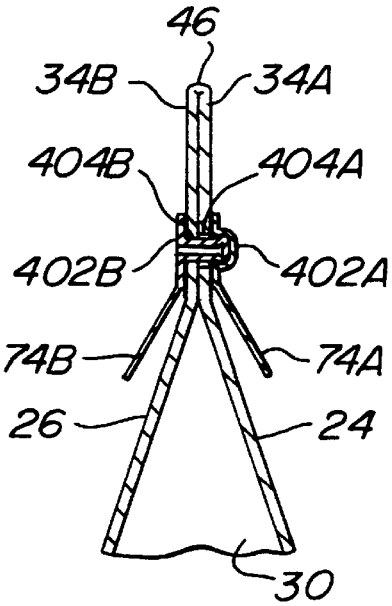
FIG. 16

CONVERTIBLE-RECLOSABLE BOX/CARTON WITH POUR SPOUT

BACKGROUND OF THE INVENTION

This invention relates generally to packages, and more particularly to boxes or cartons which are arranged to hold products, such as granular, powdery, flaked products of the free-flowing type or of bulk commodities, and which once opened are arranged to enable the contents to be readily poured therefrom via a pour-spout, and then to be re-closed to keep the contents fresh, until the package is again reopened.

Boxes or cartons for the storage and dispensing of dry cereals and other free-flowing particulate materials have typically been in the form of a paperboard or cardboard outer carton and a product-containing liner (e.g., waxed glassine paper or high-density polyethylene). In order to reseal the remaining contents in the package after opening the liner must be refolded over itself or otherwise sealed (e.g., by use of tape, a clip, a "twist-tie," etc.). Frequently, the user will not properly refold or otherwise close the liner after use, or the liner may be ripped or otherwise damaged during re-folding so as to destroy the integrity thereof. Plastic resin-based liners, while less prone to accidental tearing, which could compromise their ability to retain the freshness of the product, never the less frequently exhibit some structural "memory," so that the liner tends to resist remaining folded, e.g., it tends to unfold or unroll.

To overcome the disadvantages of lined paperboard cartons, so-called "liner-less" cartons have been developed. Liner-less cartons frequently include an openable pouring spout at the top panel of the carton or on a side or end panel. The spout is formed or opened by tearing a portion of the panel. Some spouts are arranged to be re-closed after dispensing a portion of the product therethrough. For example, some cartons provide a closure tab or "tuck-in" type of construction which engages or tucks below other carton wall components. Unfortunately this type of liner-less carton construction frequently does not provide the necessary sealing of the product remaining within the carton. Furthermore, liner-less cartons which incorporate an easily opening and reclosable pouring spout are frequently complex in construction and expensive to manufacture, e.g., they incorporate complex scoring and weakening line patterns and/or necessitate the utilization of excess amounts of paperboard or carton stock to form the package. Examples of boxes/cartons including tucked-in spouts are found in U.S. Pat. No. 3,640,446 (Grieve) and U.S. Pat. No. 2,933,230 (Yezek).

Packages including "flip-open" reclosable spouts have also been disclosed in the patent literature. See for example, U.S. Pat. No. 3,956,865 (Schermund), U.S. Pat. No. 4,421,236 (Lowe); U.S. Pat. No. 4,921,104 (Holmes); U.S. Pat. No. 4,989,780 (Foote et al.); U.S. Pat. No. 5,067,615 (Davitian); and U.S. Pat. No. 5,816,486 (Wein). Such packages are also complex in construction. Furthermore, when a prior art carton's "flip-open" pour spout is reclosed it may not provide a sufficient seal for the remaining product contained in the package to effectively extend the product's pantry shelf-life.

Other prior art cartons/boxes having reclosable pouring spouts have been disclosed in the patent literature, such as, U.S. Pat. No. 3,995,806 (McSherry); U.S. Pat. No. 4,101,051 (Reil); U.S. Pat. No. 4,464,156 (Holmstrom); U.S. Pat. No. 4,770,325 (Gordon et al.); U.S. Pat. No. 4,930,683 (Farber); U.S. Pat. No. 5,007,542 (Roccaforte); U.S. Pat. No. 5,067,613 (Bryan); U.S. Pat. No. 5,333,781 (Roccaforte); U.S. Pat. No. 5,344,066 (Fogle); U.S. Pat. No. 5,680,986 (Botterman); and U.S. Pat. No. 5,685,479 (Weber-Caspers). However, such prior art packages also suffer from one or more of the following disadvantages, e.g., inability to be stacked (due to a non-planar, e.g., gabled, top wall construction), complexity of construction, cost of manufacture, difficulty of use (e.g., opening and reclosing), and the inability to be opened and re-closed numerous times while isolating the contents of the package from the ambient atmosphere to effectively extend the pantry shelf life of the contents.

OBJECTS OF THE INVENTION

Accordingly, it is a general object of this invention to provide a package which overcomes the disadvantages of the prior art.

It is a further object of this invention to provide a carton/box for a flowable product, e.g., particulate or flaked foodstuffs, having a pour spout which may be readily opened to pour the product therethrough, and thereafter closed and sealed to effectively retain the freshness of any remaining product.

It is a further object of this invention to provide a carton/box for a flowable product having a pour spout which may be opened, reclosed and resealed numerous times to provide an extended shelf-life for the product.

It is a further object of this invention to provide a flat-topped carton/box for a flowable product which is adapted to be readily stacked up, and which has a pour spout which may be opened and reclosed numerous times.

It is a further object of this invention to provide a carton/box for a flowable product which has a pour spout which may be opened and re-closed numerous times and which is simple in construction.

It is a further object of this invention to provide a carton/box for a flowable product which has a pour spout which may be opened and re-closed numerous times and which can be manufactured inexpensively.

SUMMARY OF THE INVENTION

These and other objects of the instant invention are achieved by providing a package for containing a flowable product, e.g., dry cereal, therein. The package is in the form of a carton or box, and is made up of a planar front panel, a planar rear panel, a planar top panel, a planar bottom panel, a pair of planar side panels, and a closure assembly. All of the panels of the package are connected to one another and define between them a hollow interior for holding the pourable product.

The upper panel of the package merges with the front panel at a front corner and merges with the rear panel at a rear corner. The upper panel has a first portion arranged to be removed therefrom adjacent one of the side panels to form a spout through which the flowable product may be poured. The closure assembly comprises a first connector, e.g., plural button-like projections, located adjacent the front corner, and a second connector, e.g., plural recesses for receipt of the button-like projections, located adjacent the rear corner.

Both side panels include plural preformed lines located contiguous with the top panel. At least one of the preformed lines in each side panel is severable parallel to the plane of the top panel and is located immediately adjacent the top panel. At least one other of the preformed lines in each side panel is foldable. The top panel of the package also has a fold line extending thereacross between the side panels. The fold line is located approximately midway between the front and rear panels.

The package is arranged to be re-closed after removal of the first portion of the top panel (which action forms the spout) by folding the top panel along it's fold line and bringing portions of the front and rear panels contiguous with the front and rear corners into a confronting relationship with each other. This action causes the first connector to releasably engage the second connector to hold the front and rear panels together and to close the spout.

DESCRIPTION OF THE DRAWING

FIG. 5 is an isometric view of the top portion of a second embodiment of a package constructed in accordance with this invention, and showing that package in its initial state after having been filled and sealed;

FIG. 6 is an enlarged sectional view taken along line 6—6 of FIG. 5;

FIG. 7 is an enlarged sectional view, like that of FIG. 4, but showing the second embodiment of the package after it has been opened to form a pouring spout for pouring some of the contents of the package therethrough and then re-closed to keep the remaining contents of the package fresh;

FIG. 8 is an isometric view of the top portion of a third embodiment of a package constructed in accordance with this invention, and showing that package in its initial state after having been filled and sealed;

FIG. 9 is an enlarged sectional view taken along line 9—9 of FIG. 8;

FIG. 10 is an enlarged sectional view, like that of FIGS. 4 and 7, but showing the third embodiment of the package after it has been opened to form a pouring spout for pouring some of the contents of the package therethrough and then re-closed to keep the remaining contents of the package fresh;

FIG. 11 is an isometric view of the top portion of a fourth embodiment of a package constructed in accordance with this invention, and showing that package in its initial state after having been filled and sealed;

FIG. 12 is an enlarged sectional view taken along line 12—12 of FIG. 11;

FIG. 13 is an enlarged sectional view, like that of FIGS. 4, 7 and 10, but showing the fourth embodiment of the package after it has been opened to form a pouring spout for pouring some of the contents of the package therethrough and then re-closed to keep the remaining contents of the package fresh;

FIG. 14 is an isometric view of the top portion of a fifth embodiment of a package constructed in accordance with this invention, and showing that package in its initial state after having been filled and sealed;

FIG. 15 is an enlarged sectional view taken along line 15—15 of FIG. 14; and FIG. 16 is an enlarged sectional view, like that of FIGS. 4, 7, 10 and 13, but showing the fifth embodiment of the package after it has been opened to form a pouring spout for pouring some of the contents of the package therethrough and then re-closed to keep the remaining contents of the package fresh.

DETAILED DESCRIPTION OF THE PREFERRED EMBODIMENT

Figure 1:
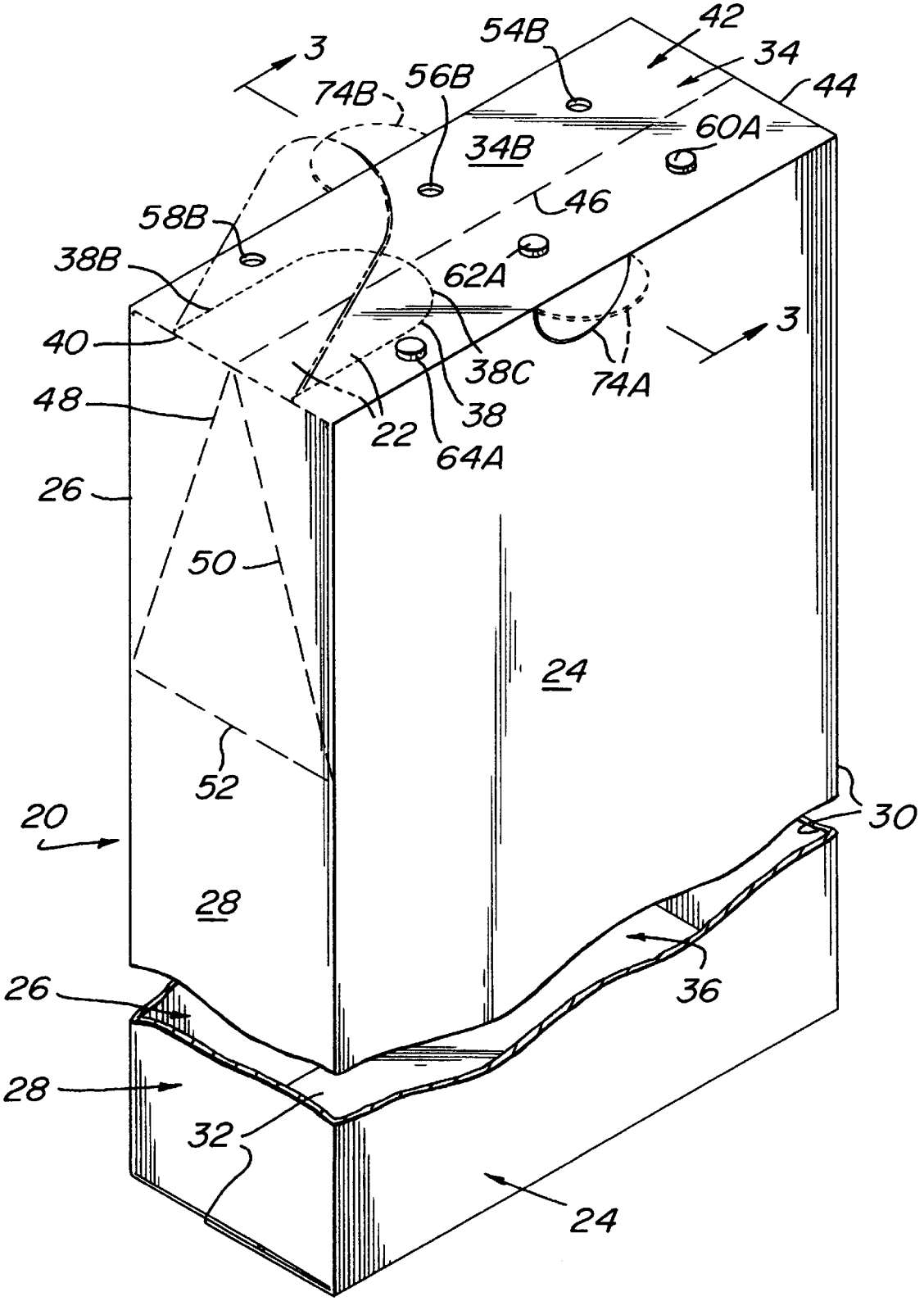
FIG. 1 is an isometric view, partially in section, of a first embodiment of a package constructed in accordance with this invention, and showing the package in its initial state after having been filled and sealed.

Referring to FIG. 1, there is shown at 20 a first preferred embodiment of a package, e.g., a box or carton, constructed in accordance with this invention. FIGS. 5, 8, 11, and 14, show respective second, third, fourth and fifth preferred embodiments of this invention and each will be described in detail later. While the embodiment 20 will be described in detail first, it should be pointed out that each of the embodiments of this invention basically comprises a similar package of generally conventional shape. The differences in the various embodiment centers on the incorporation of a pouring spout and an associated closure assembly for each package. In particular, in accordance with a basic concept of this invention the upper portion of each embodiment of the package of this invention includes an easily openable pouring spout 22, through which the contents (not shown) of the package may be readily poured. Moreover, the spout is arranged to be repeatedly opened and re-closed, with each reclosure being sufficiently secure to maintain the package in a positively closed condition to maintain the freshness of the package's contents.

The readily openable/reclosable spout of each of the packages of this invention enables the package to exhibit an extended pantry shelf-life for the product contained therein and also protects the product remaining in the package after initial opening from inadvertent spillage. Moreover, since the top of the package which includes the reclosable pouring spout is flat, one can readily stack plural packages on top of one another, a function for which conventional reclosable spout, "gabled" top packages or other packages having non-planar or recessable spouts are unsuitable.

Referring now to FIG. 1 the details of the package 20 will now be described. That package is in the form of a box or carton of generally conventional parallelopiped shape and is formed of any suitable material, e.g., paperboard or cardboard stock. The package includes a planar front panel or wall 24, a planar rear panel or wall 26, a pair of planar side panels or walls 28 and 30, a planar bottom panel or wall 32 and a planar top panel or wall 34. The panels define a hollow interior 36 therebetween for holding a dispensable/pourable product (not shown), e.g., dry cereal or other-free-flowing particulate, granular or flaky materials.

In accordance with one preferred aspect of this invention the package 20 does not need to include any separate liner, e.g., a glassine or polyethylene bag, as has characterized numerous prior art packages, e.g., dry cereal boxes, since the spout of the package of this invention is arranged to be readily re-closed after its initial opening to effectively isolate the contents from the ambient atmosphere to maintain freshness. The material making up the package is, however, fabricated so that its walls include a layer or coating of some barrier material to reduce the ingress of air and/or moisture therethrough since it is believed that package walls formed of conventional cardboard or paper board stock (without any barrier layer or coating) in and of themselves may not be sufficiently resistant to the passage of air or moisture therethrough for the expected shelf-life of a typical package for dry foodstuffs, such as cereal. Thus, for such applications the inclusion of a barrier layer or coating is desirable. However, if conventional cardboard or paperboard stock would provide the desired shelf life, the package may be fabricated without any barrier layer.

In any case, as should be appreciated from the discussion to follow, once any of the packages of this invention are re-closed, i.e., their spout is closed, a releasably securable closure assembly will hold the spout in a closed or sealed condition so that the spout is resistant to the passage of air and/or moisture therethrough.

As best seen in FIG. 1 the flat top panel or wall 34 of the package 20 includes a generally U-shaped weakened or perforated line 38 having a pair of linear side sections 38A and 38B and an arcuate intermediate section 38C. The linear side sections 38A and 38B start at the upper comer or line 40 where the top panel 34 meets the side panel 26. The line 40 is also preferably perforated or weakened line to enable it to be readily opened for reasons to be described later. The portion of the package's top wall 34 which is bounded by the perforated U-shaped line 38 and the portion of the weakened line 40 between the side sections 38A and 38B of the U-shaped line forms the heretofore identified openable/reclosable spout 22. To open the spout all that is required is to tear away the portion of the top wall of the package within those bounds. This can be accomplished by pulling up on the portion of the top wall contiguous with the arcuate section 38C (such as shown in FIG. 1), whereupon a flap is produced. The flap can then be torn off of the top wall along the portion of the weakened line 40 between the line sections 38A and 38B. This results in the formation of a generally U-shaped spout 22.

Once the spout 22 has be created, i.e., opened, the package 20 may be inverted to enable one to readily pour a desired amount of the contents of the package through the spout. After this action has been accomplished, the package's spout may be readily reclosed to seal the remaining contents within the package. In order to re-close and seal the spout 22, the package 20 includes a closure assembly 42 (whose details will be described next), a weakened line 44 at the upper comer or line where the top panel 34 meets the side panel 30, a fold line 46 in the top panel 34, and plural fold lines 48, 50, and 52 in each of the side panels 28 and 30. The fold line 46 is linear and extends between the two side panels 28 and 30 the full width of the top wall 34 centrally located between the front and rear panels 24 and 26, respectively. The fold line 46 thus divides the top panel into two sections 34A and 34B.

The fold line 52 is linear and extends the full width of the side panel 28 between the front and rear panels 24 and 26, respectively, and is parallel to the top panel 34, but located a short distance, e.g., a few inches therebelow. The fold line 48 is linear and extends from the point at which the fold line 52 merges with the rear panel 26 to the point at which the fold line 46 in the top panel merges with the weakened line 40. In a similar manner the fold line 50 is linear and extends from the point at which the fold line 52 merges with the front panel 24 to the point at which the fold line 46 in the top panel merges with the weakened line 40. The fold lines 48, 50 and 52 are similarly disposed in the other side panel 30, except that the fold lines 48 and 50 merge together at the point at which the fold line 46 in the top panel merges with the weakened line 44.

Figure 2:
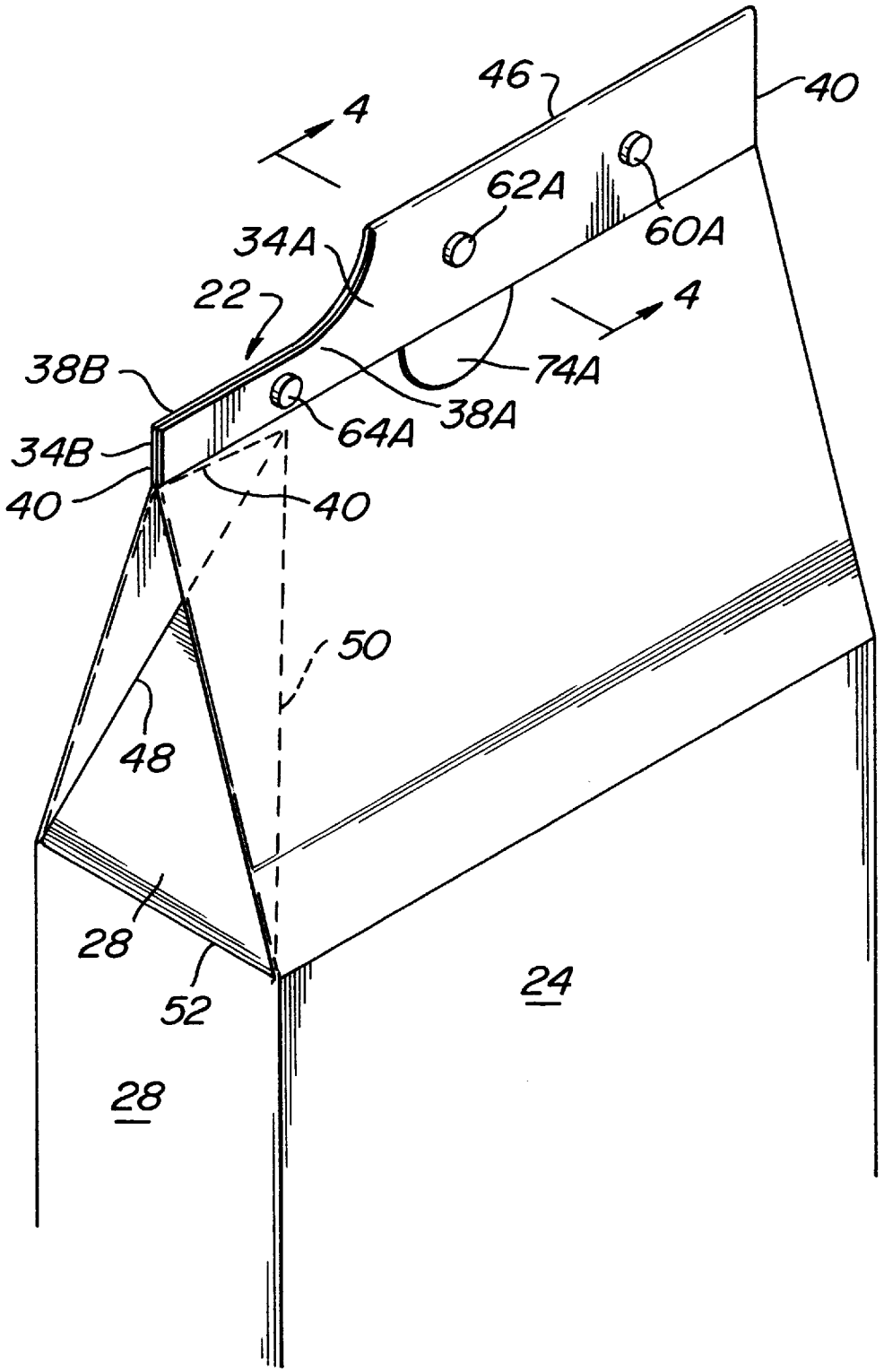
FIG. 2 is an isometric view of the top portion of the embodiment of a package of FIG. 1, but showing the package after it has been opened to form a pouring spout for pouring some of the contents of the package therethrough and then re-closed to keep the remaining contents of the package fresh.
Figure 4:
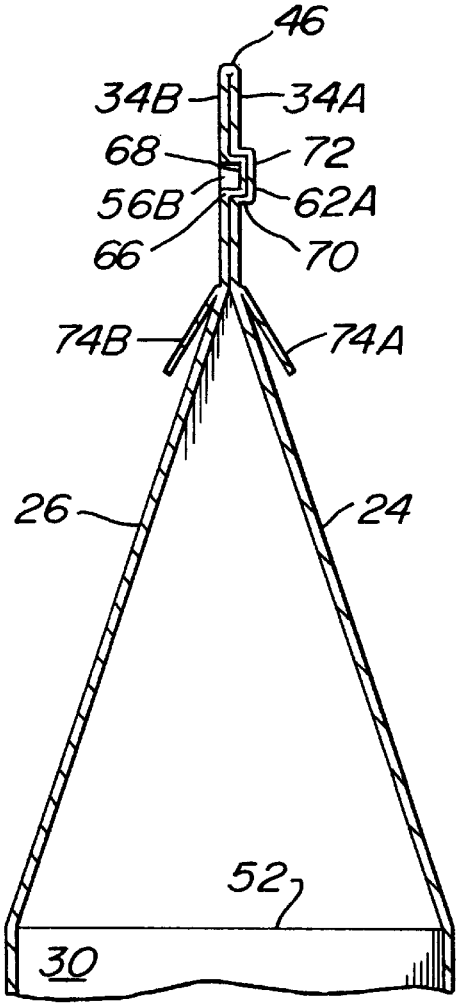
FIG. 4 is an enlarged sectional view taken along line 4—4 of FIG. 2.

The fold lines in the various panels as just described enable the upper portion of the package to be folded along them to form a peaked or gable-like top, like that shown in FIGS. 2 and 4, which closes the spout. The closure assembly 42 (to be described later) holds the spout 22 in the closed condition.

Closure of the package 20 is accomplished as follows: the user applies pressure to the upper portion of the package, e.g., presses on the front and rear panels adjacent the points at which they merge with the top panel. This action causes the unbroken, but weakened, portion of the line 40 (i.e., the portion extending beyond the margins of the spout 22) to separate or split. At the same time the entire weakened line 44 at the opposite corner of the top panel splits or separates and the top wall of the package begins to fold along line 46 to bring the portions 34A and 34B toward each other into a confronting relationship. At the same time the upper portion of the side wall 28 above the fold line 52 of the side panel 28 folds inward, while the upper portion of the side wall 30 does the same thing.

As will be appreciated by those skilled in the art when the upper portions of the two side walls bend inward above their respective fold lines 52, the angularly oriented fold lines 48 and 50 fold inward to assume the shape of inner corners of a gusset, such as shown clearly in FIG. 2.

Continued pressure or squeezing on the top portion of the package causes the two top wall sections 34A and 34B to confront each other and eventually be brought into tight abutment with each other. At this time the spout 22 is effectively closed. In particular, the portions of the top panel sections 34A and 34B which are contiguous with the margins of the spout 22 engage each other sufficiently tightly to create an air and moisture resistant interface therebetween. When the package is closed as just described the upper portion of the package, i.e., the top panel and contiguous portions of the front and rear panels is of a generally gabled shape, with the upper portions of the side panels being formed into respective gussets.

As will be appreciated from the discussion to follow the closure assembly 42 of package 20 is arranged so that when the two top wall sections 34A and 34B are brought into abutment, the elements which make up the closure assembly automatically inter-engage to hold the top wall sections 34A and 34B together and hence maintain the air and moisture resistant seal or interface. Before describing the details of the closure assembly 42, it should be pointed out that all of the closure assemblies of this invention operate in a manner whereupon the bringing of the top panel sections 34A and 34B into tight abutment automatically effects the releasable securement of the elements making up the closure assembly to hold the spout closed and to form a good air and moisture resistant interface.

Figure 3:
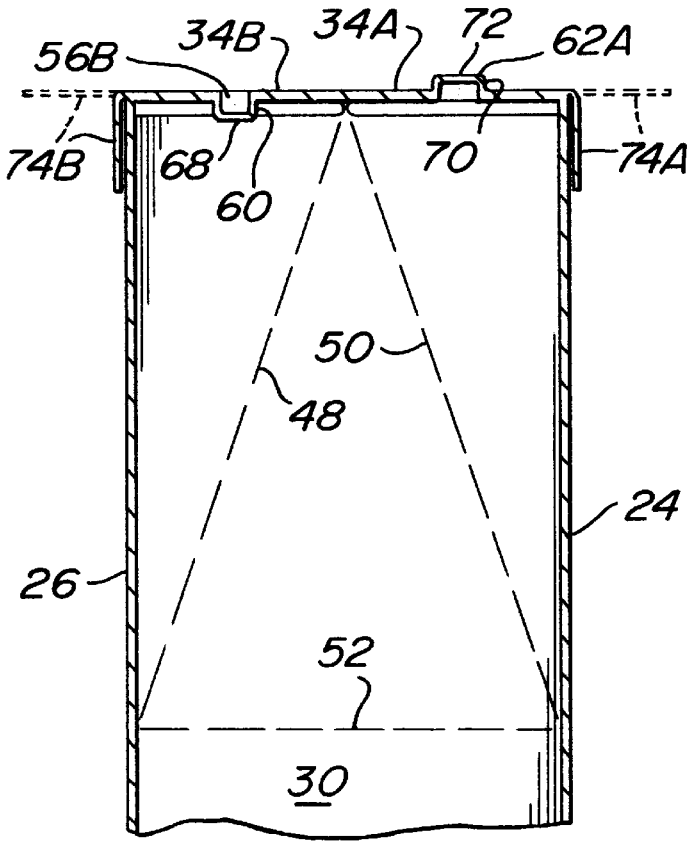
FIG. 3 is an enlarged sectional view taken along line 3—3 of FIG. 1.

Referring now to FIGS. 1–4, the details of the closure assembly 42 of the package 20 will now be described. The closure assembly basically comprises plural first connector elements 54B, 56B and 58B and second and cooperating connector elements 60B, 62B and 64B. Each of the first connector elements 54B, 56B and 58B comprises a button-like projection having a circular sidewall 66 (FIG. 3) and a planar end wall 68 (FIG. 3). The button-like projections 54B, 56B and 58B extend downward from the plane of the top panel section 34B into the interior of the package. In particular, the circular sidewall of the first connector element 56B projects downward from the top panel section 34B at the approximate center of that section. The circular sidewall of the first connector element 58B projects downward from the top panel section 34B aligned with element 56B. The circular sidewall of the first connector element 54B projects downward from the top panel section 34B immediately adjacent the marginal edge 38B of the spout-forming perforated line. Preferably, the first connector elements 54B, 56B and 58B are approximately equidistantly spaced along the width of the top panel section 34B.

Each of the second connector elements 60A, 62A and 64A comprises a circular dimple or recess having a circular sidewall 70 (FIG. 3) and a planar end wall 72 (FIG. 3), with each sidewall extending upward from the plane of the top panel section 34A. The second connector elements 60A, 62A and 64A are located in corresponding locations of the top panel section 34A as the first connector elements 54B, 56B and 58B in top panel section 34B. The inside diameter of the sidewall 70 of each of the second connector elements 60A, 62A and 64A is just slightly smaller than the outside diameter of the sidewall 66 of each of the first connector elements 54B, 56B and 58B, so that the first connector elements readily snap-fit into respective ones of the second connector elements (like shown in FIG. 3) when the two top wall sections 34B and 34A are brought into engagement to close the spout 22 as discussed above.

In order to facilitate the reopening of the spout 22, the package 20 includes a pair of tabs or ears 74A and 74B. The tab 74A is a planar member of a generally semi-circular shape and is joined to (e.g., made integral with) the top panel section 34A at approximately the middle of the package. The tab 74B is of the same construction and located in the corresponding location of the top wall section 34B. The tab 74A is initially oriented, e.g., folded down, so that it lies parallel to the front panel 24 of the package. The tab 74B is similarly oriented with respect to the rear panel 26. This feature ensures that the tabs do not take up space or interfere with the disposal of plural packages in a side by side array, such as is done during storage or vending of the packages.

Use of the tabs to facilitate the reopening of the package 20 after it had been initially opened and then re-closed so that the package is in the condition shown in FIG. 4, is as follows. The user merely grasps the tabs 74A and 74B between the thumb and index finger of each hand to unfold them from their stowed orientation shown in FIG. 2 and pulls outward. This action causes the button-like projections of the first closure elements 54B, 56B and 58B to snap out of the recesses of the second closure elements 60A, 62A and 64A, respectively, whereupon continued pulling of the tabs causes to two top panel sections 34A and 34B to spread apart into a generally planar configuration. At the same time that the two top panel section are spreading apart, the portion of the side panels 28 and 30 above the fold lines 52 pivot outward to become coplanar with the remaining portions of those panels. Accordingly, the package again assumes its original parallelopiped shape. As will be appreciated by those skilled in the art, once the portions of the top panel sections 34A and 34B contiguous with the spout 22 move out of abutment with each other the spout begins to open. When the two panel sections 34A and 34B are coplanar, the spout is completely open and the remaining contents of the package or a portion of such contents can be readily poured out of the spout. In the later case, once that portion of the contents has been poured out, the package's spout can be re-closed to seal the remaining contents within the package in the same manner as described earlier.

It must be pointed out at this juncture that the closure elements 54B, 56B and 58B can be located on the top panel section 34B while the closure elements 60A, 62A and 64A are located on the top panel section 34A instead of the manner shown herein. Thus, the embodiment of package 20 is merely exemplary.

In FIGS. 5–7 there is shown another embodiment of a package 100 of this invention. The package 100 is identical in construction to the package 20, except for the closure assembly 102 and the inclusion of plural holes or openings 104, 106 and 108 in the top panel section 34A of the package. In the interest of brevity the common components of the packages 20 and 100 will be given the same reference numbers and their description and operation will not be reiterated.

Thus, as can be seen in FIGS. 5 and 6 the closure assembly 102 basically comprises a first closure element 102A and a second closure element 102B. Each element formed of any suitable material, e.g., the same material as that forming the package 100 or plastic.

The closure element 102B basically comprises an elongated strip shaped to conform to the area of the top panel 34B excluding the portion of that panel which defines the spout 22. The strip 102B includes plural first connector elements 54B, 56B and 58B each of which comprises a button-like projection having a circular sidewall 66 (FIG. 6) and a planar end wall 68 (FIG. 6). The projections 54B, 56B and 58B extend downward from the plane of the strip 102B. The strip 102B is fixedly secured by an adhesive layer 110 onto the inner surface of the top panel section 34B so that the elements 54B, 56B and 58B project into the interior of the package. The elements 54B, 56B and 58B are located in the same position as in package 20.

The closure element 102A also comprises an elongated strip shaped to conform to the area of the top panel 34A excluding the portion of that panel which defines the spout 22. The strip 102A includes plural second connector elements 60A, 62A and 64A each of which comprises a recess having a circular sidewall 70 (FIG. 6) and a planar end wall 72 (FIG. 6). The recesses 54A, 56A and 58A extend upward from the plane of the strip 102A. The strip 102A is fixedly secured onto the inner surface of the top panel section 34A by adhesive layer 112 and the projections are located at the same locations as the holes 104, 106 and 108 in the top panel section 34A so that the elements 60A, 62A and 62B project through those holes to the exterior of the package. The button-like projection elements 54B, 56B and 58B of the strip 102B are arranged to be snap-fit into the recesses of the elements 60A, 62A and 64A of the strip 102A when the package's spout is closed, i.e., the two closure sections 102A and 102B are pivoted together along fold line 46 such as shown in FIG. 7.

The opening and closing of the spout 22 of the package 100 is effected in the same manner as described heretofore and hence will not be reiterated in the interest of brevity.

It must be pointed out at this juncture that the closure strip 102A can be located on the top panel section 34B while the closure strip 102B is located on the top panel section 34A instead of the manner shown herein. Thus, the embodiment of package 100 is merely exemplary.

In FIGS. 8–10 there is shown still another embodiment of a package 200 of this invention. The package 200 is identical in construction to the package 20, except for the closure assembly 202 and the inclusion of plural holes or openings 204A, 206A and 208A in the top panel section 34A of the package and plural holes or openings 204B, 206B and 208B in the top panel section 34B of the package. In the interest of brevity the common components of the packages 20 and 200 will be given the same reference numbers and their description and operation will not be reiterated.

Thus, as can be seen in FIGS. 8 and 9 the closure assembly 202 basically comprises a pair of closure elements 202A and 202B in the form of thin planar strips of any suitable material, e.g., the material making up the package 200 or plastic, and which are connected to each other by a transversely extending fold line 202C. The fold line 202C is coincident with the fold line 46 in the top panel 34. The holes 204B, 206B and 208B are located in the top panel section 34B in the same location as the connector elements 54B, 56B and 58B of the package 20. In a similar manner the holes 204A, 206A and 208A are located in the top panel section 34A in the same location as the projections 60A, 62A and 64A of the package 20.

The closure element 202B basically comprises an elongated strip shaped to conform to the area of the top panel 34B excluding the portion of that panel which defines the spout 22. The strip 202B includes plural first connector elements 54B, 56B and 58B each of which comprises a button-like projection having a circular sidewall 66 (FIG. 9) and a planar end wall 68 (FIG. 9). The projections 54B, 56B and 58B extend downward from the plane of the strip 202B. The strip 202B is fixedly secured by an adhesive layer 210 onto the outer surface of the top panel section 34B so that the elements 54B, 56B and 58B are located on the top panel section in the same position as in package 20 but projecting downward through the holes 204B, 206B and 208B, respectively, into the interior of the package.

The closure element 202A also comprises an elongated strip shaped to conform to the area of the top panel 34A excluding the portion of that panel which defines the spout 22. The strip 202A includes plural second connector elements 60A, 62A and 64A each of which comprises a recess having a circular sidewall 70 (FIG. 9) and a planar end wall 72 (FIG. 9). The recesses 54A, 56A and 58A extend upward from the plane of the strip 202A. The strip 202A is adhesively secured onto the exterior surface of the top panel section 34A by adhesive layer 212 and the projections are located at the same locations as the holes 104, 106 and 108 in the top panel section 34A so that the recesses of the elements 60A, 62A and 62B are accessible through those holes from the interior of the package. The button-like projection elements 54B, 56B and 58B of the strip 102B are arranged to be snap-fit into the recesses of the elements 60A, 62A and 64A of the strip 102A when the package's spout is closed, i.e., the two closure sections are pivoted together along fold line 202C such as shown in FIG. 10.

The opening and closing of the spout 22 of the package 200 is effected in the same manner as described heretofore and hence will not be reiterated in the interest of brevity.

It must be pointed out at this juncture that the closure strip 202A can be located on the top panel section 34B while the closure strip 202B is located on the top panel section 34A instead of the manner shown herein. Thus, the embodiment of package 200 is merely exemplary.

In FIGS. 11–13 there is shown still another embodiment of a package 300 of this invention. The package 300 is identical in construction to the package 20, except for the closure assembly 302 and the inclusion of a pair of slots 304A and 304B in the front and rear panels, respectively. In the interest of brevity the common components of the packages 20 and 300 will be given the same reference numbers and their description and operation will not be reiterated.

The closure assembly 302 is preferably constructed in accordance with the teachings of copending U.S. patent application Ser. No. 09/231,337, filed on Jan. 13, 1999, entitled Snap Closure for Flexible Packages and Flexible Packages Including the Same, which is assigned to the same assignee as this invention and whose disclosure is incorporated by reference herein.

Before describing the closure element the construction of the slot 304A and 304B will now be described. As can be seen in FIGS. 11–13 the slot 304A is an elongated rectangular shaped opening provided in the front panel 24 of the package 300 just slightly below and parallel to the corner at which the top panel section 34A merges with the front panel. The slot 304A is centered in the front panel and only extends partially thereacross (for reasons to be understood later). The slot 304B (FIGS. 12 and 13) is also an elongated rectangular shaped opening provided in the rear panel 26 of the package 300 just slightly below and parallel to the corner at which the top panel section 34B merges with the rear panel. The slot 304B is centered in the front panel and only extends partially thereacross (also for reasons to be understood later).

The closure assembly 302 basically comprises the pair of strips 302A and 302B which are arranged to releasably mate (e.g., snap-fit) with each other. Each of the strips is an elongate member formed of a plastic material, e.g., high or low density polyethylene or polypropylene or some other material which is slightly flexible to enable it to be bent out of its original shape by the application of force thereto, but which returns to its original shape after removal of that force. Each strip is arranged to be fixedly secured to the outer surface of either the front or rear panel of the package contiguous with and surrounding the slots 304A and 304B. To that end, each strip includes an opposed pair of end walls (to be described later). In the embodiment shown the strip 302A is mounted on the front panel 24 over the slot 304A, while the strip 302B is similarly mounted on the rear panel 26 over the slot 304B. Each closure strip is also centered on its respective panel and is of a length so that when it is mounted over its respective slot it extends only partially across the width of the panel so that it will not interfere with the gussets formed in the side panels 28 and 30 when the package is re-closed.

The strip 302B basically consists of an elongated tongue-shaped member including a pair of end walls 306 (only one of which is shown in FIG. 11), an elongated planar upper flange section 308, an elongated planar lower flange section 310 and an intermediate projecting tongue section 312. The tongue section includes a generally planar top wall 314 (FIG. 12) and a pair of undercut sidewalls 316 which merge with the upper and lower flanges 308 and 310, respectively. The planar flange sections 308 and 310 are fixedly secured to the outer surface of the front panel contiguous with the upper and lower edges of the slot 304B by any suitable securement means 320, e.g., a hot melt adhesive or any other type of adhesive, a weld joint, etc., with the tongue section 312 extending through the slot so that the marginal top and bottom edges of the slot 304B abut respective ones of the sidewalls as shown clearly in FIGS. 12 and 13. Accordingly, the tongue shaped section 312 of the closure strip 302B projects inward into the interior of the package 300. Since the ends of the strip 302B are in the form of walls 306, the positioning of the tongue-shaped portion of the strip through the slot 304B has the effect of sealing that slot, i.e., isolating the interior of the package from the exterior. A tab or ear 74B is fixedly secured to, e.g., formed integrally with, the lower flange section 310 at the center of the strip 302B.

The strip 302A basically consists of an elongated channel or trough-shaped member which an elongated planar upper flange section 322, a generally C-shaped section defining a groove or recess 324, and a lower flange section 318. A tab or ear 74A is fixedly secured to, e.g., formed integrally with, the lower flange section 326 at the center thereof. The tab 74A serves the same function as that described heretofore. The planar flange sections 322 and 326 are fixedly secured to the outer surface of the rear panel contiguous with the upper and lower edges of the slot 304 by any suitable securement means 328, e.g., a hot melt adhesive or any other type of adhesive, a weld joint, etc. so that the slot communicates with the C-shaped recess 324. The strip 302A includes a pair of end walls 328 (FIG. 11) which are located just slightly outside the marginal ends of the slot 304A so that when the strip is secured to the front panel it surrounds the slot 304B, effectively sealing that slot and isolating the interior of the package from the exterior. Moreover, the spacing between the inner surface of the end walls 328 of strip 302A is slightly greater than the spacing between the outer surface of the end walls 306 of the strip 302B to enable the tongue-shaped portion of strip 302B to readily snap-fit within the recess in strip 302A.

The package 300 is arranged to be readily re-closed after its spout has been opened (in the manner described above). To that end when the upper portions of the package 300 are squeezed together this causes the two top panel sections 34A and 34B to move into a confronting relationship with each other as described above. During this action the inwardly projecting tongue section 312 of the closure strip 302B passes through the slot 304A in the front panel to snap-fit into the recess 324 in the closure strip 302A, thereby releasably securing the two top panel sections into abutment. The abutment of those top panel sections closes the spout 22 in the same manner as described earlier.

Since the closure strips 302A and 302B are centered on the front and rear panels, respectively, and only extend partially across the width of the package they will not interfere with the gussets formed in the side panels when the package is re-closed. Moreover, since their end walls are sealed air cannot gain ingress into the package therethrough, nor can the remaining contents of the package spill out.

In order to reopen the package, all that is required is for the user to pull the tabs 74A and 74B apart to cause the top panel sections to pivot upward into a coplanar configuration, whereupon the spout 22 is fully open.

It must be pointed out at this juncture that the strips 302A and 302B can be mounted and secured to the rear panel 26 and front panel 24, respectively, instead of to the front panel 24 and rear panel 26, respectively, as shown herein. Thus, the embodiment of package 300 is merely exemplary.

In FIGS. 14–16 there is shown still another embodiment of a package 400 of this invention. The package 400 is identical in construction to the package 300, except for the closure assembly 400 and the inclusion of a pair of slots 404A and 404B in the top panel sections 34A and 34B, respectively. In the interest of brevity the common components of the packages 300 and 400 will be given the same reference numbers and their description and operation will not be reiterated.

The slot 404A is an elongated rectangularly shaped slot similar to slot 304, located in the top panel section 34A contiguous with the upper corner at which that panel section merges with the front panel 24. However, the slot 404A extends the full width of the package, i.e., the full distance between the side panels 28 and 30. The slot 404B is also an elongated rectangularly shaped slot, similar to slot 304B, located in the top panel section 34B contiguous with the upper corner at which that panel section merges with the rear panel 26. The slot 404B also extends the full width of the package 400.

The closure assembly 402 is preferably constructed identically to the closure assembly 302, except that its respective closure strips 402A and 402B are longer in length than the closure strips 302A and 302B. The closure strip 402B is mounted onto the outer surface of the top panel section 34B contiguous with the slot 404B, by adhesively securing its planar flange sections 308 and 310 to the portions of the top panel section 34B contiguous with the upper and lower edges of the slot 406, with the tongue section 312 extending downward through the slot 406 into the interior of the package 400 and with the end walls 306 sealing the slot in the same manner as described earlier. The planar flange sections 322 and 326 of the closure strip 402A are fixedly secured to the outer surface of the top panel section 34A contiguous with the upper and lower edges of the slot 404, so that the C-shaped recess 324 in that strip communicates with the slot 404, and with the end walls 328 sealing the end of the slot in the same manner as described earlier.

The package 400 is arranged to be readily re-closed after its spout has been opened (in the same manner as described above). To that end, when the upper portions of the package 400 are squeezed together this causes the two top panel sections 34A and 34B to move into a confronting relationship with each other. During this action the inwardly projecting tongue section 312 of the closure strip 402B passes through the slot 404A in the top panel section 34A to snap-fit into the recess 324 in the associated closure strip 402A, thereby releasably securing the two top panel sections into abutment. The abutment of those top panel sections closes the spout 22, while the snap-fitting securement of the two strips holds the spout closed.

As should be appreciated by those skilled in the art the closure strips 402A and 402B can be longer than the strips 302A and 302B without interfering with the gussets formed in the side panels of the package 400 when it is re-closed since the strips 402A and 402B are mounted on the top panel sections 34A and 34B, respectively, instead of being mounted on the front and rear panels.

In order to reopen the package, all that is required is for the user to pull the tabs 74A and 74B apart to cause the top panel sections to pivot upward into a coplanar configuration, whereupon the spout 22 is fully open.

It must be pointed out at this juncture that the strips 402A and 402B can be mounted and secured to the top panel sections 34B and 34A, respectively, instead of to the top panel sections 34 A and 34B, respectively, as shown herein. Thus, the embodiment of package 400 is merely exemplary.

It should be pointed out at this juncture that the various closure assemblies described above and shown in the drawing are exemplary of a myriad of types, shapes, sizes of releasably securable connector elements which can be used in a package constructed in accordance with this invention. Moreover, the closure assemblies can be located either on the top panel sections or on the adjacent portions of the front and rear panels of the package. Thus, the embodiments as described above should not be deemed to be limiting of the subject invention. Moreover, the shape and construction of the package of this invention is not limited to that shown, but can be of any configuration having a generally planar upper wall or panel including a reclosable spout and an opposed pair of front and rear panels or walls.

As should be appreciated from the foregoing, the subject invention provides a package which can be of conventional size and shape for ease of storage and transportation, can be readily opened to provide initial access to its contents via a pour spout, and then readily re-closed and reopened as often as desired, while maintaining the freshness of its contents. Moreover, when the package is re-closed the amount of interior head space is automatically reduced. This feature aids in maintaining freshness of the remaining contents.

Without further elaboration the foregoing will so fully illustrate my invention that others may, by applying current or future knowledge, adopt the same for use under various conditions of service.

I claim:

1. A package for containing a flowable product therein, said package being in the form of a carton or box, said package having a planar front panel, a planar rear panel, a planar top panel, a planar bottom panel, a pair of planar side panels, and a closure, all of said panels being connected to one another and defining therebetween a hollow interior for holding the pourable product therein, said upper panel merging with said front panel at a front corner and merging with said rear panel at a rear corner, said upper panel having a first portion arranged to be removed therefrom adjacent one of said side panels to form a spout through which the flowable product may be poured, said closure comprising a first connector located adjacent said front corner and a second connector located adjacent said rear corner, said side panels including plural preformed lines located contiguous with said top panel, at least one of said lines being severable parallel to the plane of said top panel and being located immediately adjacent thereto, at least one other of said lines being foldable, said top panel having a fold line extending thereacross approximately midway between said side panels and being located between said front and rear panels, said package being arranged to be re-closed after removal of said first portion of said top panel by folding said top panel along said fold line and bringing portions of said front and rear panel contiguous with said front and rear corners into a confronting relationship, whereupon said first connector releasably engages said second connector to hold said front and rear panels together and to close said spout.

2. The package of claim 1 wherein said top panel includes two sections, one section being located adjacent said front corner and the other being located adjacent said rear corner.

3. The package of claim 2 wherein said two sections of said top panel are mounted so as to be pivotable towards each other.

4. The package of claim 3 wherein said first connector is mounted on said top panel adjacent said front corner, and said second connector is mounted on said top panel adjacent said rear corner.

5. The package of claim 4 wherein said first connector comprises at least one projecting member and said second connector comprises at least one recess adapted to releasably receive said at least one projecting member therein.

6. The package of claim 5 wherein said first connector comprise plural button-like members and said second connector comprises plural recessed members.

7. The package of claim 5 wherein said first connector is formed integrally with said one section of said top panel adjacent said front corner, and said second connector is formed integrally with said other section of said top panel adjacent said rear corner.

8. The package of claim 5 wherein said top panel has an inside surface and wherein said first connector comprises a strip mounted on said inside surface of said top panel adjacent said front corner and wherein said second connector comprises a strip mounted on said inside surface of said top panel adjacent said rear corner.

9. The package of claim 5 wherein said top panel has an outside surface and wherein said first connector comprises a strip mounted on said outside surface of said top panel adjacent said front corner and wherein said second connector comprises a strip mounted on said outside surface of said top panel adjacent said rear comer.

10. The package of claim 1 wherein said first connector is mounted on said front panel adjacent said front corner, and said second connector is mounted on said rear panel adjacent said rear corner.

11. The package of claim 1 wherein one of said first and second connectors comprises an elongated tongue-shaped member, and wherein the other of said first and second connectors comprises an elongated trough-shaped member.

12. The package of claim 10 wherein one of said first and second connectors comprises an elongated tongue-shaped member, and wherein the other of said first and second connectors comprises an elongated trough-shaped member.

13. The package of claim 3 wherein one of said first and second connectors comprises an elongated tongue-shaped member, and wherein the other of said first and second connectors comprises an elongated trough-shaped member.

14. The package of claim 1 wherein said preformed lines comprise a pair of foldable lines, said foldable lines extending from approximately the middle of said severable line to respective ones of said front and rear panels.

15. The package of claim 1 wherein at least one of said preformed lines is weakened.

16. The package of claim 14 wherein at least one of said preformed lines is weakened.

17. The package of claim 1 wherein said first portion of said top panel is of a generally U-shape.

18. The package of claim 17 wherein said first portion of said top panel is bounded by a weakened U-shaped line.

19. The package of claim 17 wherein said first portion of said top panel is located contiguous with one of said side panels.

20. The package of claim 14 wherein said foldable lines fold when said first and second closure elements are brought into releasable engagement to form a gabled top for said package.

21. The package of claim 1 wherein said package is formed of paperboard or cardboard.

22. The package of claim 21 wherein said paperboard or cardboard includes a barrier forming material layer.

23. The package of claim 22 wherein said barrier forming material is a plastic material.

24. The package of claim 1 additionally comprising a pair of projecting tabs to facilitate the re-opening of said package.

25. The package of claim 24 wherein said tabs are mounted contiguous with said front and rear corners.

26. The package of claim 1 wherein said package comprises at least one opening therein and wherein said first connector comprises at least one projecting member and said second connector comprises at least one recess adapted to releasably receive said at least one projecting member through said at least one opening.

27. The package of claim 26 wherein said top panel includes two sections, one section being located adjacent said front corner and the other being located adjacent said rear corner.

28. The package of claim 27 wherein said two sections of said top panel are mounted so as to be pivotable towards each other.

29. The package of claim 28 wherein said first connector is mounted on said top panel adjacent said front corner, and said second connector is mounted on said top panel adjacent said rear corner.

30. The package of claim 28 wherein said first connector is mounted on said front panel adjacent said front corner, and said second connector is mounted on said rear panel adjacent said rear corner.

31. The package of claim 1 wherein when said package is re-closed said package exhibits a reduced head space in said hollow interior.

32. The package of claim 31 wherein when said portions of said front and rear panel contiguous with said front and rear corners are brought into said confronting relationship said top portion of said package assumes a gable shape, thereby resulting in said reduced head space in said hollow interior.

* * * * *